US005604477A

United States Patent [19]

Rainer et al.

[11] Patent Number: 5,604,477

[45] Date of Patent: Feb. 18, 1997

[54] SURFACE MOUNT RESISTOR AND METHOD FOR MAKING SAME

[75] Inventors: Walter Rainer, Duncan; Joel J. Smejkal, Columbus; Steve E. Hendricks, Columbus; Gary E. Bougger, Columbus, all of Nebr.

[73] Assignee: Dale Electronics, Inc., Columbus, Nebr.

[21] Appl. No.: 350,960

[22] Filed: Dec. 7, 1994

[51] Int. Cl.[6] ..... H01C 3/12

[52] U.S. Cl. ..... 338/293; 338/308; 338/314; 29/621

[58] Field of Search ..... 338/293, 308, 338/309, 22 R, 22 SD, 314; 29/621, 411; 361/403

[56] References Cited

U.S. PATENT DOCUMENTS

| | | |
|---|---|---|
| 696,757 | 4/1902 | Rypinski . |
| 765,889 | 7/1904 | Harris . |
| 779,737 | 1/1905 | Robinson . |
| 859,255 | 7/1907 | Roller . |
| 1,050,563 | 1/1913 | Roller . |
| 2,003,625 | 6/1935 | Boyer . |
| 2,271,995 | 2/1942 | Baroni . |
| 2,708,701 | 5/1955 | Viola . |
| 2,736,785 | 2/1956 | DuBois . |
| 3,245,021 | 4/1966 | Keruander et al. . |
| 4,286,249 | 8/1981 | Lewis et al. . |
| 4,684,916 | 8/1987 | Ozawa . |
| 4,689,475 | 8/1987 | Kleiner et al. . |
| 4,800,253 | 1/1989 | Kleiner et al. . |
| 4,993,142 | 2/1991 | Burke et al. . |

FOREIGN PATENT DOCUMENTS

9320911 U 12/1992 Germany .

OTHER PUBLICATIONS

Title: Advances In Connector Design Using Electron Beam Welded Strip R. M. Grubb and D. W. M. Williams. Publication:Electronic Packaging and Production Title: EB-welded Dual-metal Strip Aids Contact Fabrication, Nov. 1978.

*Primary Examiner*—Tu B. Hoang
*Attorney, Agent, or Firm*—Zarley, McKee, Thomte, Voorhees, & Sease

[57] ABSTRACT

A surface mount resistor is formed by joining three strips of material together in edge to edge relation. The upper and lower strips are formed from copper and the center strip is formed from an electrically resistive material. The resistive material is coated with epoxy, and the upper and lower strips are coated with tin or solder. The strips may be moved in a continuous path and cut, calibrated, and separated for forming a plurality of electrical resistors.

12 Claims, 8 Drawing Sheets

SURFACE MOUNT RESISTOR AND METHOD FOR MAKING SAME

BACKGROUND OF THE INVENTION

The present invention relates to a surface mount resistor and method for making same.

Surface mount resistors have been available for the electronics market for many years. Their construction has comprised a flat rectangular or cylindrically shaped ceramic substrate with a high conductivity metal plated to the ends of the ceramic to form the electrical termination points. A resistive metal film is deposited on the ceramic substrate between the terminations, making electrical contact with each of the terminations to form an electrically continuous path for current to flow from one termination to the other. The metal resistive film is "adjusted" to the desired resistance value by abrading or by using a laser to remove some of the resistive material. A protective coating is then applied over the resistive film material to provide protection from various environments to which the resistor may be exposed.

One limitation to present prior art designs for surface mounted resistors is that low resistance values less than 1.0 ohms are difficult to achieve. Sophisticated process steps are required and the results are often poor with high per unit manufacturing costs.

Therefore a primary object of the present invention is the provision of an improved surface mount resistor and method for making same.

A further object of the present invention is the provision of an improved surface mount resistor which can produce low resistance values.

A further object of the present invention is the provision of an improved surface mount resistor which utilizes a metal resistance strip in lieu of metal resistance film to achieve very low resistance values and high resistance stability.

A further object of the present invention is the provision of an improved surface mount resistor which is constructed by welding so as to handle the large electrical currents associated with low resistance values.

A further object of the present invention is the provision of an improved surface mount resistor which can use a laser, mechanical abrasion, or both for adjusting the resistive element to the desired resistance value.

A further object of the present invention is the provision of an improved surface mount resistor which incorporates all of the above features and maintains a surface mount design.

A further object of the present invention is the provision of an improved method for making a surface mount resistor which utilizes a "reel-to-reel" manufacturing process which is continuous and which can produce high volumes with low manufacturing cost.

A further object of the present invention is the provision of an improved surface mount resistor and method for making same which are economical in manufacture, durable in use, and efficient in operation.

SUMMARY OF THE INVENTION

The foregoing objects are achieved by a surface mount resistor formed from an elongated first piece of electrically resistive material having first and second end edges, opposite side edges, a front face and a rear face. The piece of resistive material has a thickness between the front and rear faces and has a plurality of slots formed therein which create a serpentine current path for current moving between the first and second end edges.

Second and third pieces of conductive metal each include a front face, a rear face, an edge and a thickness between the front and rear faces thereof. Portions of each of the edges of the second and third pieces are attached to the first and second end edges respectively of the first piece. The thicknesses of the second and third pieces are greater than the thickness of the first piece of resistive material. A dielectric material surrounds and encapsulates the first piece of resistive material, and a coating of solder surrounds and coats the second and third pieces so as to create leads for the resistor.

The resistor is made by a method which comprises taking the first strip of electrically resistive material and attaching the second and third strips of conductive metal to the upper and lower edges respectively of the first strip of resistive material. The second and third strips of conductive material each have a thickness greater than the first thickness of the first strip of electrically resistive material. The method then comprises the step of adjusting the resistance value of the first strip of resistive material by cutting a plurality of slots through the first strip of resistive material to form a serpentine current path. The cutting may be accomplished by abrasive cutting, stamping, or by the use of a laser beam to form the various slots and anneal the edges thereof. The use of the laser is the preferred method.

Next an electrically insulative encapsulating material is applied to the strip of electrically resistive material so as to encapsulate it. Solder is then coated on the second and third strips of conductive material to complete the formation of the resistor.

DETAILED DESCRIPTION OF THE PREFERRED EMBODIMENT

Figure 1:
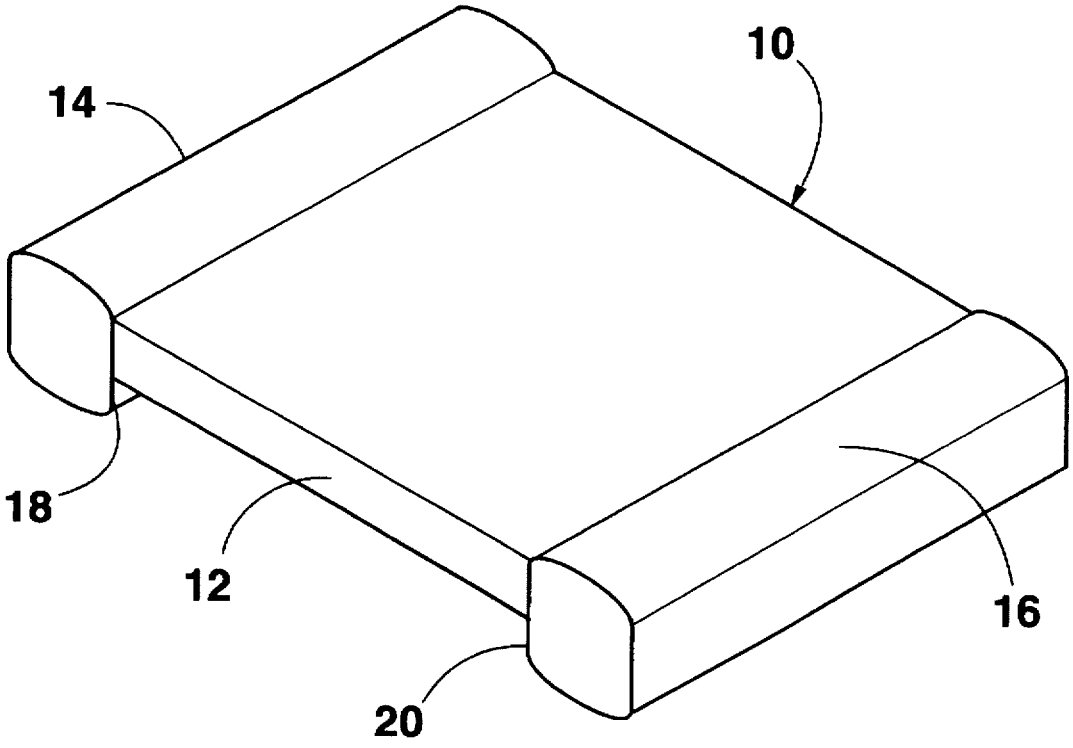
FIG. 1 is a pictorial view of the surface mount resistor of the present invention.

Referring to FIG. 1 an electrical surface mount resistor 10 is shown and includes a central resistive portion 12, a first lead 14, a second lead 16, a first stand-off 18 and a second stand-off 20. The two stand-offs 18, 20 permit the resistor to be mounted on a surface with the resistive portion 12 suspended above the supporting surface.

Figure 2:
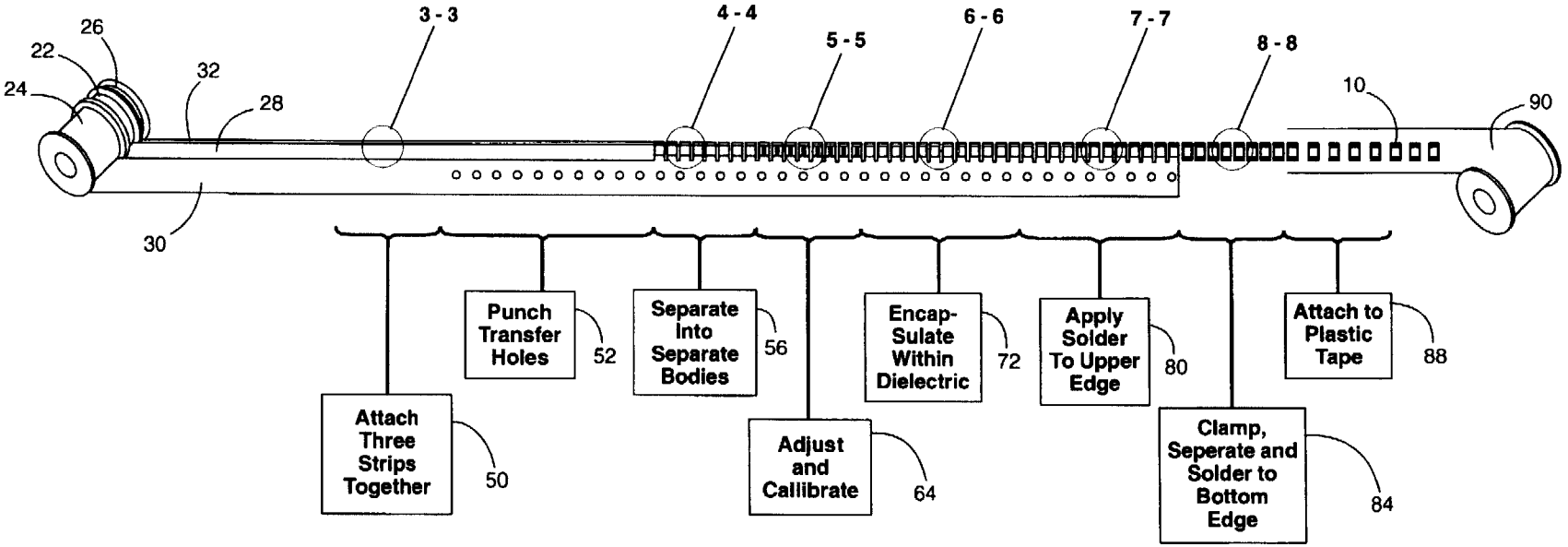
FIG. 2 is a schematic flow diagram showing the process for making the present resistor.

FIG. 2 schematically illustrates the method for making the resistor 10 shown in FIG. 1. A reel 22 includes a strip of resistive material 28 wound there around. The preferred material for the resistive material is nickel chromium, but other well known resistive materials such as nickel iron or a copper based alloy may be used.

A second reel 24 includes a wider lower strip 30 of copper, or solder coated copper, and a third reel 26 includes a narrow upper strip 32 of the same material. The thicknesses of the copper strips 30, 32 are greater than the thickness of the metal resistance strip so as to provide the stand-offs 18, 20 shown in FIG. 1. These thicker copper strips also provide clearance for material encapsulating the resistive strip 28 as described hereinafter.

Figure 3:
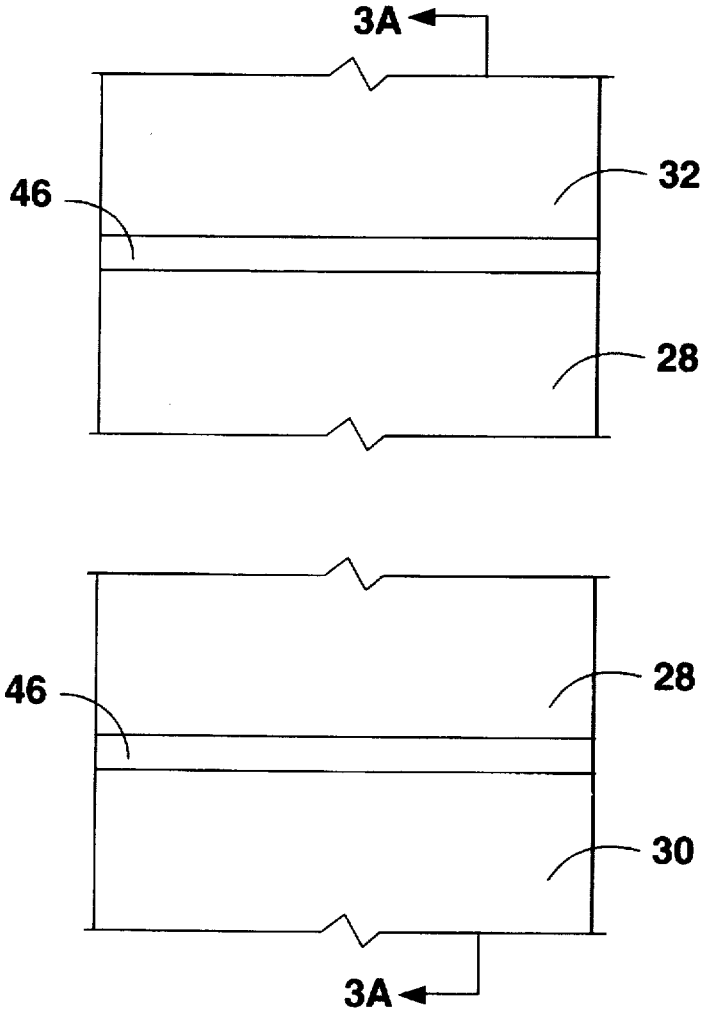
FIG. 3 is an enlarged view taken along line 3—3 of FIG. 2.
Figure 3A:
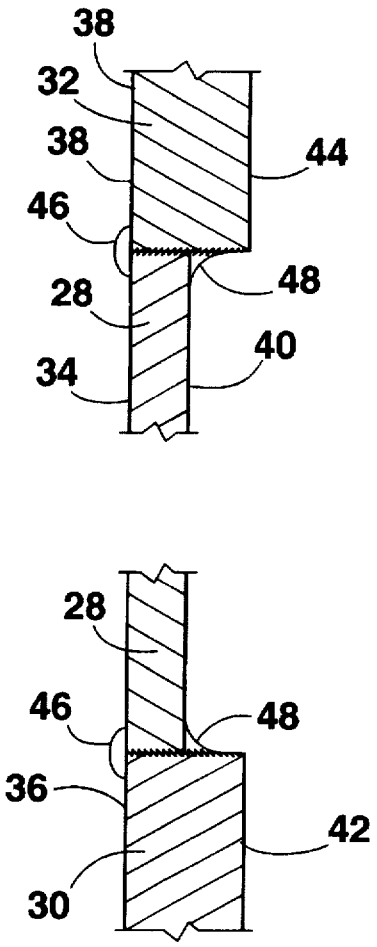
FIG. 3A is a sectional view taken along line 3A—3A of FIG. 3.
Figure 4:
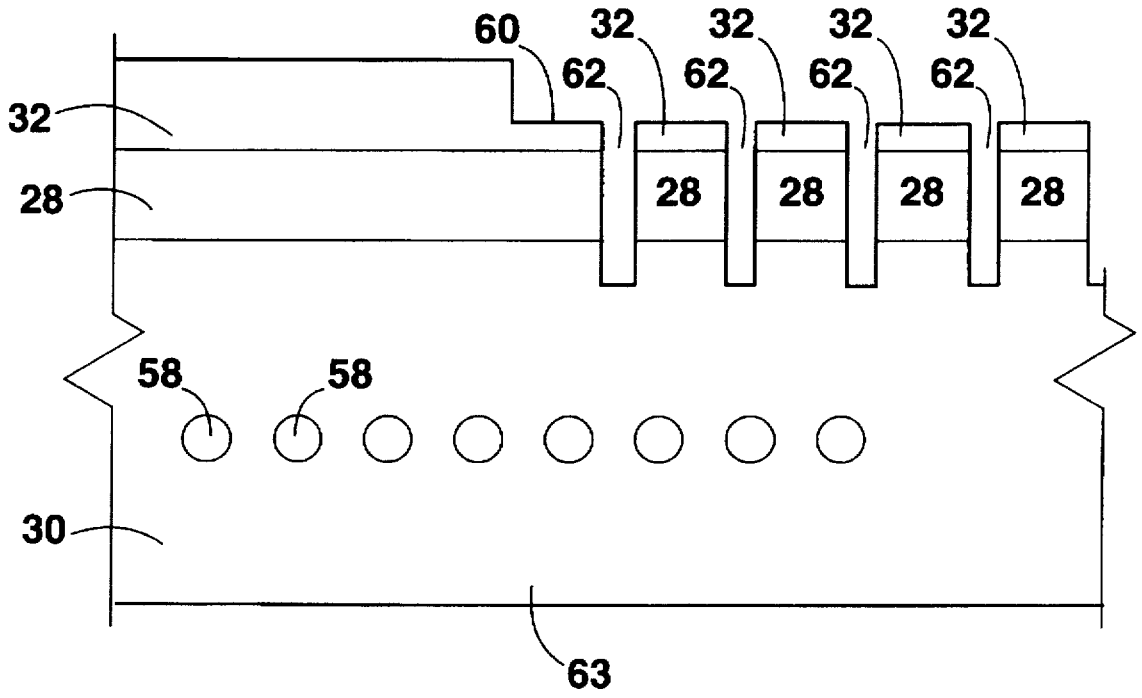
FIG. 4 is an enlarged view taken along line 4—4 of FIG. 2.

The numeral 50 designates a welding station wherein the lower strip 30, the upper strip 32, and the resistive strip 28 are welded together in the manner shown in FIG. 3. The resistive strip 28 includes a front surface 34 and a rear surface 40. The lower strip 30 includes a front surface 36 and a rear surface 42; and the upper strip 32 includes a front surface 38 and a rear surface 44. As can be seen in FIG. 3A, the front surfaces 34, 36, 38 are coplanar with one another and are joined by a pair of front weld joints 46. The rear surfaces 42, 44 of the lower and upper strips 30, 32 respectively extend rearwardly from the rear surface 40 of the resistive strip 28 and are joined by rear weld joints 48. The weld joints 46, 48 are preferably formed by an electron beam welder. Numerous machines for accomplishing this welding operation are available. The preferred way of accomplishing this process is to contract with Technical Materials, Inc., Lincoln, R.I., which owns such a welding machine, to weld the lower strip 30, the upper strip 32, and the resistive strip 28 together into a single strip, and to turn the upper and lower strips 28, 30 to proper length.

After the strips 28, 30, 32 have been welded together and trimmed to length they are moved sequentially to a punching station 52 and a separating station 56. The punching station 52, punches a plurality of index holes 58 which will be used for alignment purposes in later operations.

At the separating station, the separating slots 62 are formed by punching or other conventional means. The purpose is to form individual resistor blanks of the proper width from the continuous strip of material, and to electrically isolate each resistor blank so that resistance readings may be taken in later operations. The slots 62 extend downwardly through the upper strip 32, the middle strip 28, and partially through the lower strip 30, while at the same time leaving a connected portion 63 at the lower edge of strip 30 so as to provide for continuous processing of the strips. The upper strip 32 then becomes an upper edge 60 of each resistor blank.

Figure 5:
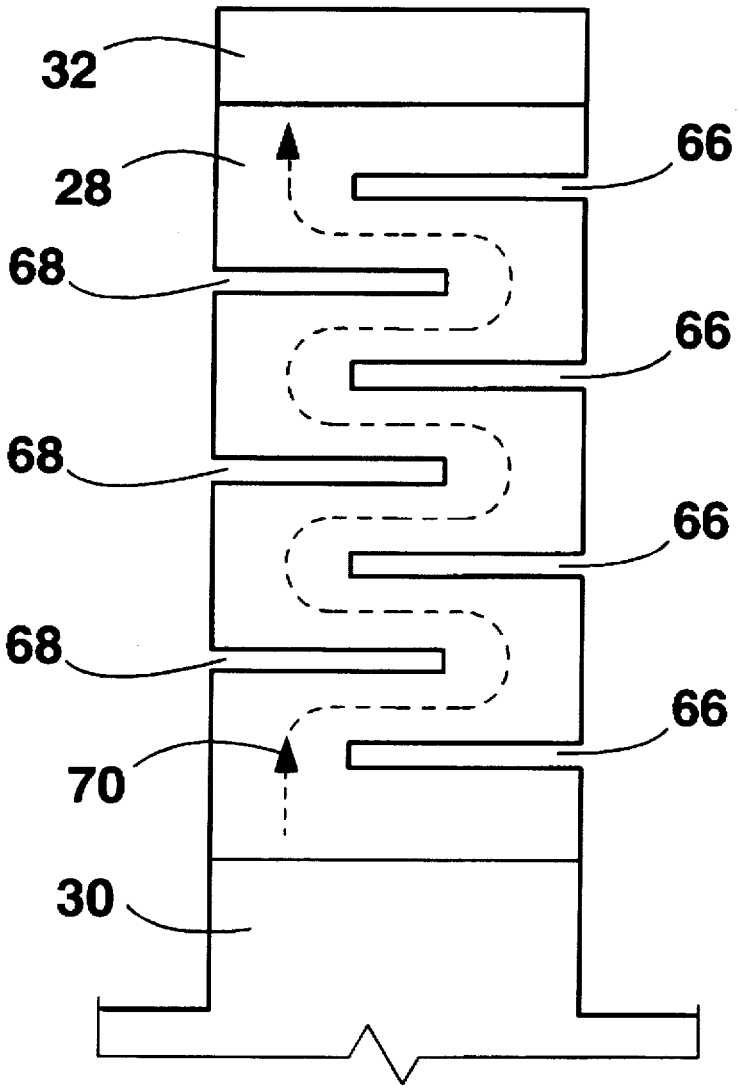
FIG. 5 is an enlarged view taken along line 5—5 of FIG. 2.

The separated resistor blanks are next moved to an adjustment and calibration station 64. At this station each resistor blank is adjusted to the desired resistance value. Resistance value adjustment is accomplished by cutting alternative slots 66, 68 (FIG. 5) through the resistance material 28 to form a serpentine current path designated by the arrow 70. This increases the resistance value. The slots are cut through the resistance material 28 using preferably a laser beam or any instrument used for the cutting of metallic materials. The resistance value of each resistor is continuously monitored during the resistance value adjustment operation.

Figure 6:
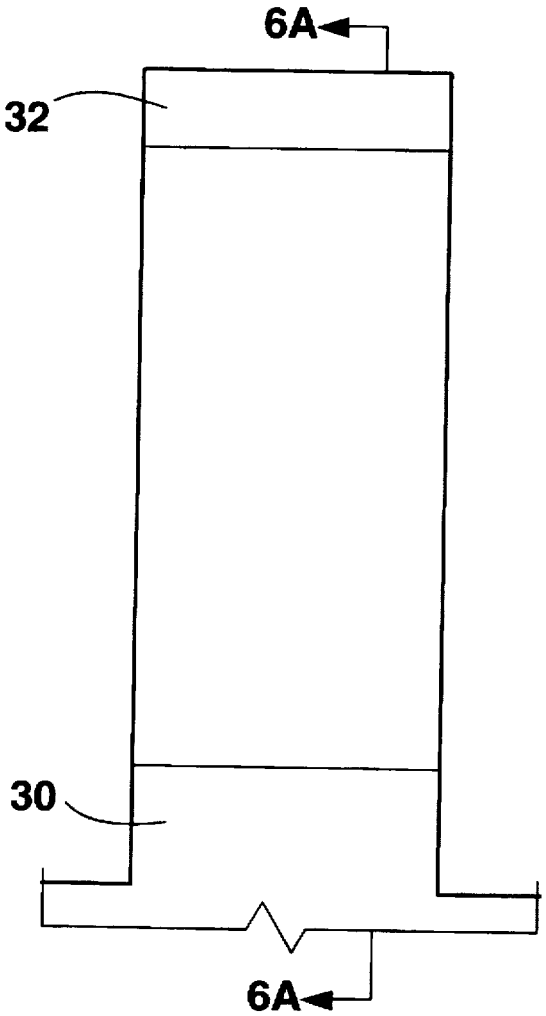
FIG. 6 is an enlarged view taken along line 6—6 of FIG. 2.
Figure 6A:
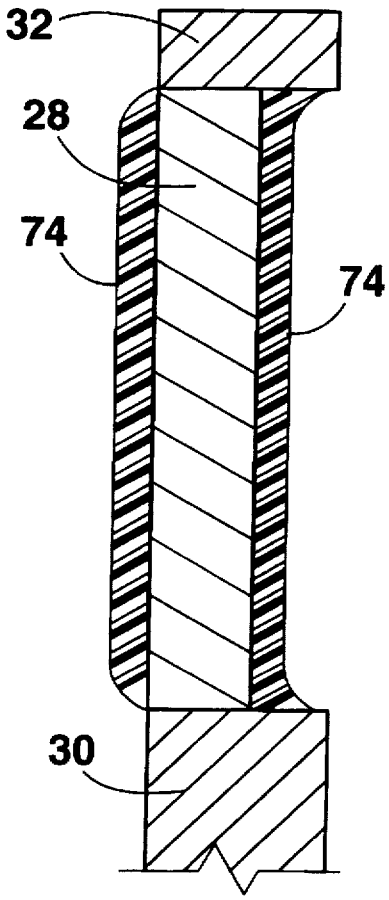
FIG. 6A is a sectional view taken along line 6A—6A of FIG. 6.
Figure 7:
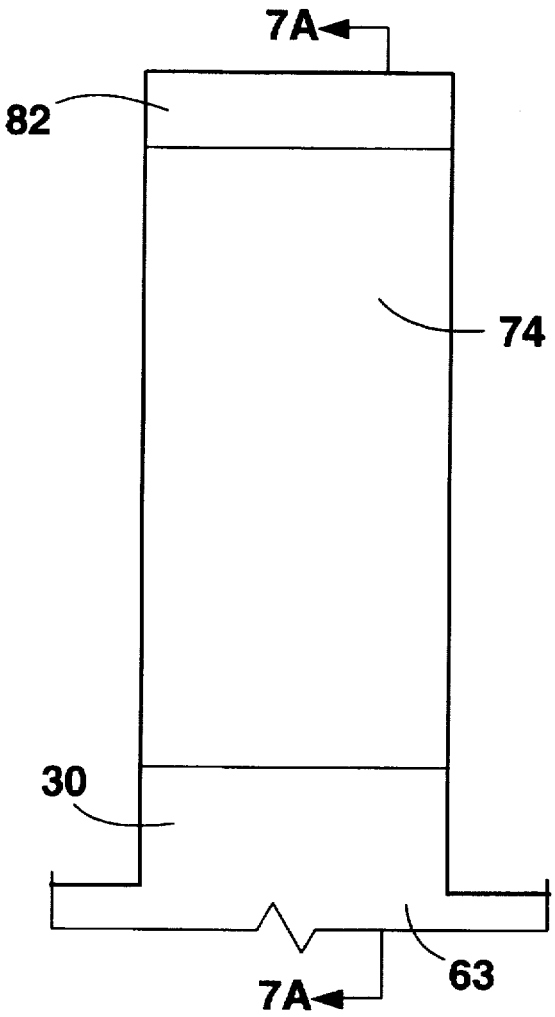
FIG. 7 is an enlarged view taken along line 7—7 of FIG. 2.
Figure 7A:
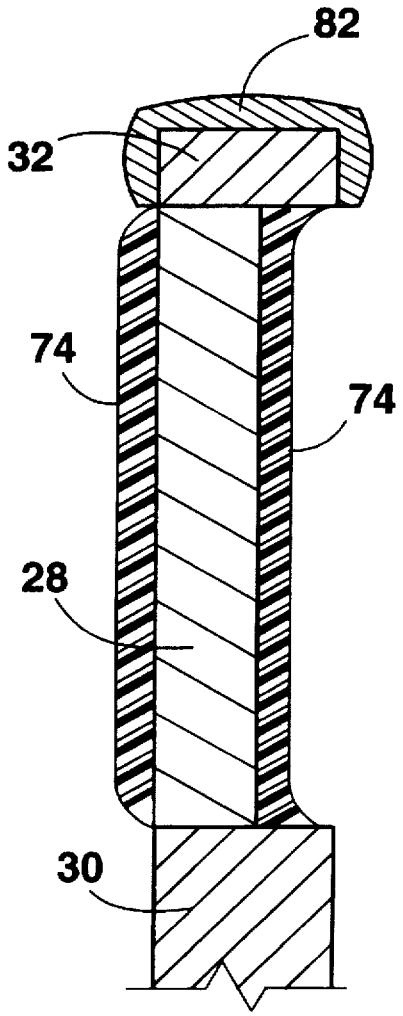

After the resistors are adjusted to their proper resistance value the strip is moved to an encapsulation station 72 where a dielectric encapsulating material 74 (FIG. 6A) is applied to both the front and rear surfaces and the edges of the resistance elements. The purpose of the encapsulating operation is to provide protection from various environments to which the resistor may be exposed; to add rigidity to the resistance element which has been weakened by the value adjustment operation; and to provide a dielectric insulation to insulate the resistor from other components or metallic surfaces it may contact during its actual operation. The encapsulating material 74 is applied in a manner which only covers the resistive element materials 28. A liquid epoxy material roll coated to both sides of the resistor body is the preferred method. The copper ends 30, 32 of the resistor are left exposed. These copper ends 30, 32 of the resistor serve as the electrical contact points for the resistor when it is fastened to the printed circuit board by the end user. Since the copper ends 30, 32 on the resistor are thicker than the resistive element 28 in the center of the resistor, the necessary clearance is provided for the encapsulation on the bottom side of the resistor as shown in FIG. 6A.

Figure 8:
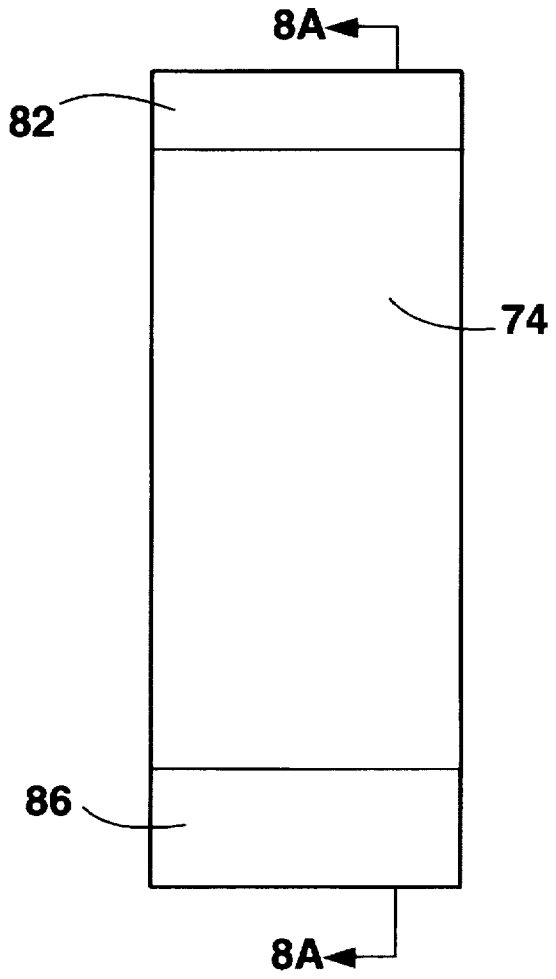
FIG. 8 is an enlarged view taken along line 8—8 of FIG. 2.
Figure 8A:
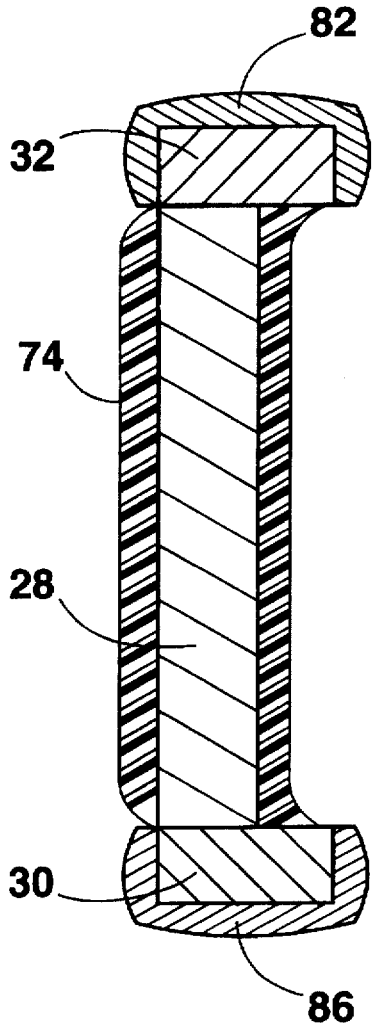
FIG. 8A is a sectional view taken along line 8*a*—8*a* of FIG. 8.

The final manufacturing operation is to coat the termination pads 30, 32 with solder to facilitate easy attachment to a printed circuit board by the end user. Dipping the ends 30, 32 in molten solder is the preferred method. The upper ends 32 are dipped in the solder to create a solder coating 82 (FIGS. 8, 8A) while the strip is still held in one piece by the connecting portion 63. The strip is then moved to the clamping, separating, and soldering station 84 where the individual resistors are clamped together and then the connecting portion 63 is cut away so that the resistors are separate from one another, but held by the clamp. The lower ends 30 of the resistors are then dipped in solder to create a solder coating 86 for the lower strips 30.

The individual resistors 10 are then complete and they are attached to a plastic tape 90 at a packaging station 88.

The above process can be accomplished in one continuous operation as illustrated in FIG. 2, or it is possible to do the various operations one at a time on the complete strip. For example, the welding operation can be accomplished first and the completed welded roll wound on a spool. The punching of the transfer hole's, the trimming and the separation can then be accomplished by unwinding the spool and moving the strip through stations 52, 54, 56 to accomplish these operations. Similar operations can be accomplished one at a time by unwinding the spool for each operation.

For the welding operation the preferred method of welding is by electron beam welding. But other types of welding or attachment may be used.

The preferred method for forming the transfer holes, for trimming the upper edge of the strip to length, and for forming the separate resistor blanks is punching. However, other methods such as cutting with lasers, drilling, etching, and grinding may be used.

The preferred method for calibrating the resistor is to cut the resistor with a laser. However, punching, milling, grinding, or other conventional means may be used.

The dielectric material used for the resistor is preferably a rolled epoxy, but various types of paint, silicon, and glass in the forms of liquid, powder or paste may be used. They may be applied by molding, spraying, brushing, or static dispensing.

The solder which is applied may be a hot tin dip which is preferable or maybe a conventional solder paste or plating.

In the drawings and specification there has been set forth a preferred embodiment of the invention, and although specific terms are employed, these are used in a generic and descriptive sense only and not for purposes of limitation. Changes in the form and the proportion of parts as well as in the substitution of equivalents are contemplated as circumstances may suggest or render expedient without departing from the spirit or scope of the invention as further defined in the following claims.

What is claimed is:

1. A method for making a surface mount resistor comprising:

taking a first strip of electrically resistive material having an upper edge, a lower edge and first and second opposite faces, said first and second opposite faces being spaced apart a first thickness from one another;

attaching a second strip of conductive metal to said upper edge of said first strip of resistive material;

attaching a third strip of conductive metal to said lower edge of said first strip of resistive material;

said second and third strips of conductive metal each having a thickness greater than said first thickness of said first strip of electrically resistive material;

adjusting the resistance value of said first strip of resistive material by cutting a plurality of slots through said first strip of resistive material to form a serpentine current path;

applying an electrically insulative encapsulating material only to said first strip of electrically resistive material so as to encapsulate said first strip of electrically resistive material within said encapsulating material; and coating said second and third strips of conductive material with solder.

2. A method according to claim 1 and further comprising forming a rectangular piece out of said first strip of resistive material and said second and third strips of conductive metal after said attaching of said first and second strips of conductive metal to said strip of resistive material.

3. A method according to claim 1 wherein said attaching of said second and third strips of conductive material is accomplished by welding.

4. A method according to claim 1 wherein said adjusting of the resistive value of said first strip of resistive material is accomplished by using a laser beam to cut said plurality of slots through said first strip of resistive material.

5. A method for making a plurality of surface mount resistors comprising:

taking an elongated first strip of electrically resistive material having first and second opposite ends, an upper edge, a lower edge, and first and second opposite faces spaced apart a first thickness from one another;

attaching an elongated second strip of conductive metal to said upper edge of said strip of resistive material;

attaching an elongated third strip of conductive metal to said lower edges of said strip of resistive material;

sectioning said elongated first, second, and third strips into a plurality of separate body members after said second and third strips have been attached to said upper and lower edges respectively of said first strip;

adjusting the resistance value of said resistive material in each of said plurality of body members by cutting a plurality of slots through said resistive material to create a serpentine current path in said resistive material of each of said body members;

encapsulating said resistive material of each of said body members in a coating of electrically insulative material; and coating said second and third strips of conductive metal with solder.

6. A method according to claim 5 and further comprising moving said elongated first, second, and third strips longitudinally in parallel relation to one another to an attachment station wherein said attaching steps are performed, to a sectioning station where said sectioning step is performed, and to an adjusting station where said adjusting step is performed.

7. A method according to claim 6 and further comprising moving said first, second, and third strips to an encapsulating station wherein said encapsulating step is performed and to a coating station wherein said coating step is performed.

8. A method according to claim 6 and further comprising punching index holes in one of said second and third strips for permitting alignment of said first, second, and third strips during said adjusting, encapsulating, and coating steps.

9. A method according to claim 8 and further comprising leaving a portion of said one of said second and third strips unsectioned during said sectioning process whereby said plurality of body members will be interconnected by said unsectioned portion after said sectioning step.

10. A surface mount resistor comprising:

an elongated first piece of electrically resistive material having first and second end edges, opposite side edges, a front face and a rear face, said piece of resistive material having a thickness between said front and rear faces and having a plurality of slots formed therein which create a serpentine current path for current moving between said first and second end edges;

second and third pieces of conductive metal each having a front face, a rear face, an edge and a thickness between said front and rear faces thereof;

a portion of each of the edges of said second and third pieces being attached to said first and second end edges respectively of said first piece;

said thickness of said second and third pieces being greater than said thickness of said first piece;

a dielectric material surrounding and encapsulating only said first piece;

a coating of solder surrounding and coating said second and third pieces.

11. A surface mount resistor according to claim 10 wherein said first piece and said dielectric material together form a body of increased thickness over the thickness of said first piece alone, said thicknesses of said second and third pieces being greater than said increased thickness.

12. A surface mounted resistor according to claim 10 wherein said front faces of said first, second, and third pieces are substantially coplanar.

* * * * *